US006317645B1

(12) United States Patent
Jansen et al.

(10) Patent No.: US 6,317,645 B1
(45) Date of Patent: Nov. 13, 2001

(54) SUCTION-AIR SYSTEM OF A TEXTILE MACHINE

(75) Inventors: Gerd Jansen, Viersen; Stephan Weuthen; Karl Kemps, both of Mönchengladbach, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/348,401

(22) Filed: Jul. 7, 1999

(30) Foreign Application Priority Data

Jul. 8, 1998 (DE) ..... 198 30 394

(51) Int. Cl.[7] ..... D01G 31/00; D01H 11/00; G08B 17/12

(52) U.S. Cl. ..... 700/139; 700/143; 57/305; 340/628; 19/205

(58) Field of Search ..... 700/130, 139, 700/142, 143, 144; 57/300, 304, 305; 15/300.1; 19/205; 340/628

(56) References Cited

U.S. PATENT DOCUMENTS 5,819,373 * 10/1998 Schlicter et al. ..... 19/205
5,936,531 * 8/1999 Powers ..... 340/628

FOREIGN PATENT DOCUMENTS

| | | |
|---|---|---|
| 619 991 A5 | 10/1980 | (CH) . |
| 676 475 A5 | 1/1991 | (CH) . |
| 2 426 961 | 12/1974 | (DE) . |
| 297 19 245 U1 | 4/1998 | (DE) . |
| 0000 033 B1 | 10/1990 | (EP) . |

* cited by examiner

*Primary Examiner*—Peter Nerbun
(74) *Attorney, Agent, or Firm*—Kennedy Covington Lobdell & Hickman, LLP

(57) ABSTRACT

A suction-air system of a textile machine, especially a rotor spinning machine, has at least one suction-air conduit, at least one spark sensor for detecting flying sparks within a measuring extent of the suction-air, the sensor including a measuring device with a sensing range at least partially overlapping the measuring extent, at least one electromagnetic wave receiver for generating an output signal when a spark enters the sensing range, and a driver and evaluation circuit for the measuring device. At least one source for generating electromagnetic waves is associated with the receiver and actuates a purposeful initiation of the spark sensor.

20 Claims, 1 Drawing Sheet

SUCTION-AIR SYSTEM OF A TEXTILE MACHINE

FIELD OF THE INVENTION

The present invention relates to a suction-air system of a textile machine, especially a rotor spinning machine. More particularly, the present invention relates to such a suction-air system having at least one suction-air conduit, at least one spark sensor for detecting flying sparks within a measuring extent of the suction-air system wherein the sensor comprises a measuring device whose sensing range overlaps the measuring extent at least partially, at least one electromagnetic wave receiver which generates an output signal when a spark enters into the sensing range, and a driver and evaluation circuit for the measuring device.

BACKGROUND OF THE INVENTION

Suction-air systems of the basic type described above are known. Thus, for example, German Patent Publication DE 24 26 961 B2 describes a fire detector which is arranged in a suction-air system of a rotor spinning machine. The task of such a fire detector is to monitor fiber fly of the rotor spinning machine transported within a suction-air conduit for any spark formation. Such a spark formation can arise, e.g., because a rotor of the rotor spinning machine overheats, which can cause an ignition of fibers. Such ignited fibers can be transported via the suction-air conduit over relatively large distances, e.g. into air-conditioning equipment, so that considerable fire damage can occur.

It is known that such fire detectors (referred to herein as spark sensors) can be provided with an optical receiver for electromagnetic waves which receiver senses, in particular, infrared signals emitted by a spark. Such electromagnetic waves can be converted into an electrical signal by a photoelement, e.g., a photodiode. This electrical signal can be evaluated with a driver and evaluation circuit. Normally, the photoelements are loaded with a resting current, or zero-signal current, which changes into a switching current after the incidence of an electromagnetic wave to initiate an event-dependent action. This action can be, e.g., an alarm signal to operating personnel of the rotor spinning machine, an automatic deactuation of the rotor spinning machine, the activation of an extinguishing device or the like.

While they are being used according to regulation, spark sensors are exposed to significant stress, so that a checking of the operation of the spark sensors is necessary for reliable operation. As a result of the defined switching states of the spark sensors between the resting current, on the one hand, and the switching current, on the other hand, an electrical check can be performed by means of a testing algorithm via the driver and evaluation circuit. In the case of any short circuit of the leads to the measuring device, a current flows which is greater than the resting current, whereas in the case of an interruption of the lead of the measuring device no current flows. In the case of both error states, an alarm signal can be generated which indicates a failure of the spark sensor.

However, it is a disadvantage that checking of the optical structural elements of the spark sensor is not possible, so that an operational safety of 100% can not be assured by the electrical test.

SUMMARY OF THE INVENTION

It is accordingly an object of the present invention to provide a suction-air system of the basic type described above which offers increased operating safety in a simple manner.

The invention solves this problem by providing a suction-air in a textile machine which basically comprises at least one suction-air conduit, at least one spark sensor for detecting flying sparks within a measuring extent of the suction-air system, the sensor comprising a measuring device having a sensing range overlapping at least partially the measuring extent, at least one receiver of electromagnetic waves adapted for generating an output signal when a spark enters the sensing range of the measuring device, and a driver and evaluation circuit for the measuring device. According to the present invention, at least one source for generating electromagnetic waves is provided in association with the at least one electromagnetic wave receiver and is operable for purposefully initiating the spark sensor. As a result, the optical components of the spark sensor can be checked in an advantageous manner in addition to the checking of the electrical and electronic components of the spark sensor, so that a recognition of sparks by the spark sensor becomes significantly more reliable.

A preferred development of the invention provides that that the at least one electromagnetic wave generating source can be actuated periodically and the alarm function of the driver and evaluation circuit can be faded out or otherwise deactuated, preferably during the periodically repeating actuation of the electromagnetic wave generating source for self-testing of the optical components of the spark sensor. Thus, the optical components of the spark sensor can be checked in a simple manner and at determinable intervals, during which the initiation of the alarm current of the spark sensor does not result in an initiation of a false alarm signal as a consequence of the testing of the measuring device.

A further, preferred development of the invention provides that the electromagnetic wave source is a light-emitting diode which can preferably be driven via the driver and evaluation circuit of the measuring device. As a result thereof, the periodic activation of the electromagnetic wave source can be combined in a simple manner with the deactuation of the alarm function without any great expense for circuit technology being necessary.

Furthermore, another preferred development of the invention provides that the source for generating electromagnetic waves and the spark sensor are arranged in a common housing. This makes it possible to create a compact structural form of the spark sensor. A common electrical interface with the driver and evaluation circuit of the spark sensor can preferably be used. This results in a simplified assembly expense since the arrangement and the electrical connection of additional components is not necessary.

The invention will be further explained and understood from the description of an exemplary embodiment set forth in the following specification with reference to the associated drawings.

DETAILED DESCRIPTION OF THE PREFERRED EMBODIMENT

Figure 1:
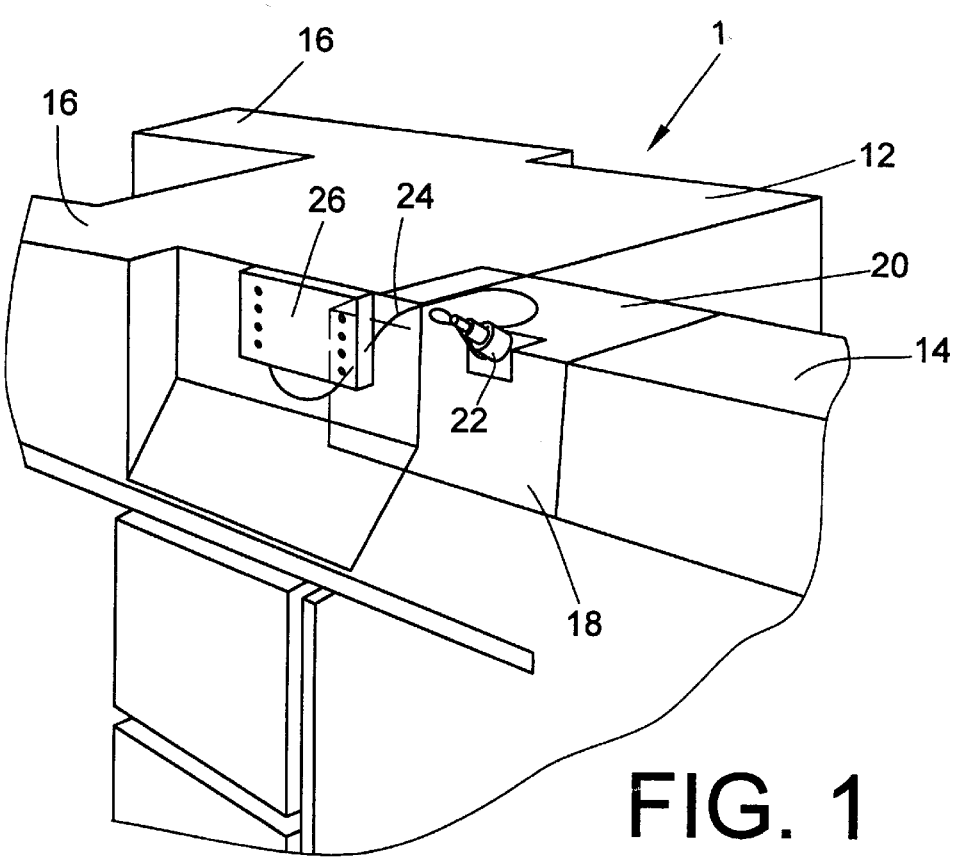
FIG. 1 is a schematic perspective view of an arrangement of a spark sensor on a suction-air system of a rotor spinning machine, in accordance with a preferred embodiment of the present invention.

Referring now to the accompanying drawings and initially to FIG. 1, a suction-air system 10 for at least one rotor spinning machine is shown in a fragmentary perspective view. As will be understood, several rotor spinning machines, each with a plurality of spinning units, can be connected to suction-air system 10. The design and method of operation of the suction-air system and of such rotor spinning machines are known, so that they do not have to be discussed in detail in the framework of the present specification. A vacuum is applied to the rotor spinning machines by means of suction-air system 10, by which fiber waste, impurities and the like are removed by suction from the rotor spinning machines.

To this end, suction-air system 10 comprises a so-called end unit 12 into which communicates suction-air conduit 14 connected to a source of suction air (not shown). Furthermore, suction-air conduits 16 leading to the individual rotor spinning machines empty into end unit 12. Section 18 of suction-air conduit 14 forms a measuring extent 20 for spark sensor 22, whose design and method of operation will be explained in more detail with reference to FIG. 2. Spark sensor 22 is connected via electrical connecting lead 24 to control device 26 which comprises a driver and evaluation circuit for spark sensor 22.

During the regular operation of suction-air system 10, the fiber waste accumulating on the rotor spinning machines is conducted via the flow of suction air to a filter or separating device. A feeding of sliver on the part of the rotor spinning machine is not turned off as a consequence of an operating disturbance in the rotor spinning machines, e.g., in the case of a yarn break, and the rotor of the rotor spinning machine can be fed too much sliver, causing the rotor to overheat. The frictional heat thereby created can be sufficient to ignite the fiber waste transported off by the flow of suction air. This waste would then be conducted as flowing fiber waste via suction conduits 16, 14 to the filter or separating device, where it could result in ignition of the collected fiber waste.

The fiber fly is monitored by spark sensor 22 in the area of measuring extent 20, during which electromagnetic waves in the infrared range emitted by glowing fibers are detected by an optical receiver. This makes it possible to recognize flying sparks within suction-air system 10 and to initiate appropriate countermeasures via control device 26. These measures can consist, e.g., in generating an optical and/or acoustic alarm so that operating personnel of the rotor spinning machines can initiate appropriate countermeasures. Furthermore, the rotor spinning machines can be automatically turned off. In addition, the direction of the conveyance of air in suction-air system 10 can be reversed or otherwise switched such that, when glowing fiber fly occurs, it is not transported in the direction of the filter and separating device but rather can be directed into a separate storage area optionally equipped with extinguishing means.

Figure 2:
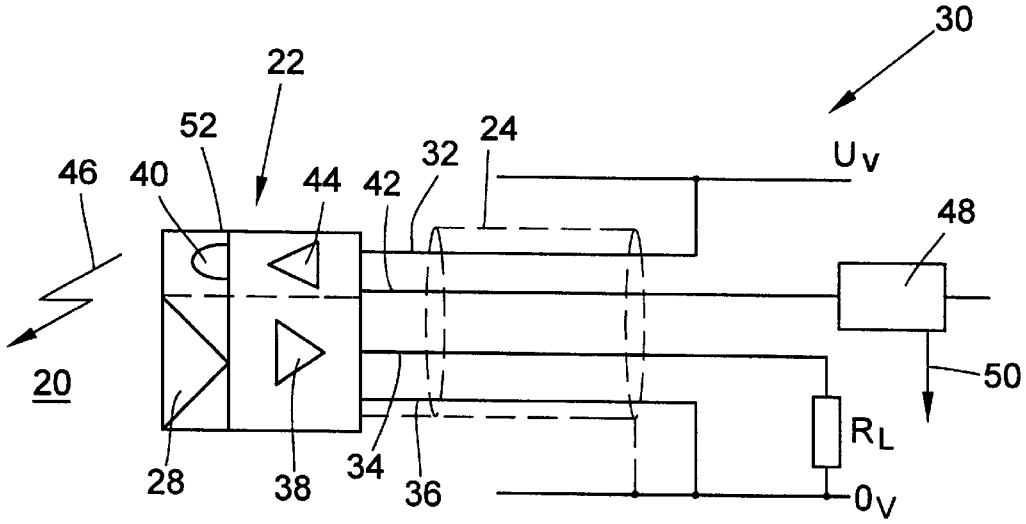
FIG. 2 is a schematic diagram of an operating circuit of the spark sensor in the system of FIG. 1.

FIG. 2 shows spark sensor 22 in a block diagram. This sensor comprises optical receiver 28, whose sensing range is directed into measuring extent 20. The sensing range encompasses, e.g., an angle of detection of 110°, within which glowing fiber waste transported in measuring extent 20 is recognized. The entire cross section of measuring extent 20 can be detected through the detection angle of 110° by arranging spark sensor 22 at a corner of suction-air conduit 14, which is preferably designed in an angular configuration. Spark sensor 22 is connected via electrical connecting lead 24 to driver and evaluation circuit 30, shown here only representatively. Connecting lead 24 is designed as a four-wire lead in which a first wire 32 serves to make available a supply voltage $U_v$ of, e.g., 24 Volts. A second wire 34 and a third wire 36 serve to tap off an electrical signal of optical receiver 28. Optical receiver 28 is, for example, a photodiode which drives a resting current of, for example, 20 mA via a current interface. If a spark appears in measuring extent 20, infrared electromagnetic waves emitted by the spark are received by optical receiver 28 and converted into an electrical signal. This electrical signal effects a switching of the resting current into an alarm current of, for example, 4 mA which can be evaluated by control device 26. Amplifier circuit 38 can be provided to amplify the electrical signals generated by optical receiver 28.

Moreover, spark sensor 22 comprises source 40 for generating electromagnetic waves in a wavelength range which corresponds to the receivable wavelengths of optical receiver 28, thus, in the infrared range in the present embodiment. Source 40 is preferably designed as a light-emitting diode. Source 40 can be driven with a control pulse via a fourth wire 42 of connecting lead 24. In order to amplify the control pulse, amplifier circuit 44 can be provided. Corresponding to the function of source 40, the control pulse produces infrared flash 46 within measuring extent 20, which flash is recognized by optical receiver 28. Driver and evaluation circuit 30 comprises timing element 48 by which a defined pulse length, on the one hand, and a pulse interval, on the other hand, can be adjusted. The pulse length determines the period of actuation time of source 40 and is at least 1.1 times, preferably at least 1.5 times, a reaction time of optical receiver 28. This assures that generated infrared flash 46 is actually recognized by optical receiver 28. The interval between successive pulses can be selected as appropriate or otherwise desired, e.g., in the range of seconds, minutes, hours or the like. Control signal 50 is generated synchronously with the pulse signal by timing element 48. Control signal 50 informs control device 26 that an infrared signal detected by spark sensor 22 was not produced by flying sparks inside the suction-air system but rather that this signal was generated by a purposeful and defined actuation of source 40. In this manner an initiation of an alarm can be suppressed by control device 26 for the duration of the pulse.

A self-test of spark sensor 22, especially of its optical receiver 28, can thereby be performed by means of a purposeful activation of source 40. A periodic checking of the operation of spark sensor 22 is thus possible corresponding to the repetition frequency of the test pulses, without the sensor having to be removed from suction-air system 10, for example. In addition to this checking of the optical operation of spark sensor 22, a checking of the electrical operation can take place in a known manner by monitoring the resting current. If the resting current exceeds a set value, e.g., 20 mA, a short circuit inside connecting lead 24 or inside spark sensor 22 is indicated. If the resting current is interrupted, for example, an interruption of an electrical lead is indicated.

Control device 26 comprises, for example, an optical display which displays a failure of spark sensor 22. An appropriate replacement of the defective spark sensor 22 can then be performed by the operating personnel. Furthermore, an automatic error signal can be transmitted to a central data processor serving to control the rotor spinning machines so that, in addition to a documentation of the error signal, a defective spark sensor 22 can be identified at the same time.

Instead of or in addition to actuating the test pulses via timing element 48, source 40 can also be actuated manually via a separate switching means by an operating person. This makes a manual check possible at any time, in addition to or independently of the set repetition frequency of the test pulses. Thus, the operation of spark sensor 22 can be tested, e.g., during a check round by operating personnel by actuating the switching means. Control device 26 can make appropriate acknowledging signals available, e.g., optically, for the operating person so that he recognizes whether spark sensor 22 is in working order or defective.

Optical receiver 28, source 40 and amplifier circuits 38, 44 are arranged in common housing 52 formed, e.g., by a cylindrical plastic tube. This makes a very compact method of construction possible. Spark sensor 22 is connected to control device 26 by only one connecting lead 24, here a four-wire lead as described above, so that spark sensor 22 can be connected in a simple manner via an interface.

It is of course possible, according to further exemplary embodiments which are not shown to arrange source 40 independently of spark sensor 22, e.g., in measuring extent 20 diametrically opposite spark sensor 22. A self-test of spark sensor 22 is also possible in this manner, during which the mode of operation remains the same.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A suction-air system of a textile machine, comprising at least one suction-air conduit, at least one spark sensor for detecting flying sparks within a measuring extent of the suction-air system, the sensor comprising a measuring device having a sensing range overlapping at least partially the measuring extent, at least one receiver of electromagnetic waves adapted for generating an output signal when a spark enters the sensing range of the measuring device, a driver and evaluation circuit for the measuring device, and at least one source for generating electromagnetic waves associated with the at least one electromagnetic wave receiver, the at least one electromagnetic wave generating source being operable for purposefully initiating the spark sensor.

2. The suction-air system according to claim 1, characterized in that the textile machine is a rotor spinning machine.

3. The suction-air system according to claim 1, characterized in that the at least one electromagnetic wave generating source is operable periodically.

4. The suction-air system according to claim 3, characterized in that each actuation of the at least one electromagnetic wave generating source endures for a period of at least about 1.1 times the reaction time of the at least one electromagnetic wave receiver.

5. The suction-air system according to claim 4, characterized in that each actuation of the at least one electromagnetic wave generating source endures for a period of at least about 1.5 times the reaction time of the at least one electromagnetic wave receiver.

6. The suction-air system according to claim 1, characterized in that at least one electromagnetic wave generating source and the spark sensor are integrated in a common housing.

7. The suction-air system according to claim 1, characterized in that the at least one electromagnetic wave receiver comprises a photoelement.

8. The suction-air system according to claim 7, characterized in that the at least one electromagnetic wave receiver comprises a photodiode.

9. The suction-air system according to claim 1, characterized in that the at least one electromagnetic wave generating source comprises a transmitting diode.

10. The suction-air system according to claim 1, characterized in that the at least one electromagnetic wave generating source comprises a light emitting diode (LED).

11. The suction-air system according to claim 1, characterized in that the at least one electromagnetic wave generating source and the at least one electromagnetic wave receiver operate in an infrared range.

12. The suction-air system according to claim 1, characterized in that the at least one electromagnetic wave generating source is actuable via a separate control lead.

13. The suction-air system according to claim 1, characterized in that the at least one electromagnetic wave generating source is actuable by the driver and evaluation circuit.

14. The suction-air system according to claim 13, characterized in that the at least one electromagnetic wave generating source and the spark sensor are connected by a common connecting lead to the driver and evaluation circuit.

15. The suction-air system according to claim 1, characterized in that the at least one electromagnetic wave generating source is actuable manually.

16. The suction-air system according to claim 1, characterized in that the textile machine further comprises at least one safety device actuable by the spark sensor.

17. The suction-air system according to claim 1, characterized further by a control device comprising the driver and evaluation circuit and adapted to actuate at least one of an acoustic alarm signal, an optical alarm signal, a switching of the suction-air conduit, an automatic deactuation of the textile machine, an automatic documentation, and a display of an error signal.

18. The suction-air system according to claim 1, characterized in that the driver and evaluation circuit is adapted to perform an electrical test of the spark sensor while monitoring a resting current of the receiver.

19. The suction-air system according to claim 1, characterized in that the driver and evaluation circuit comprises a timing element for controlling a control pulse for actuating the at least one electromagnetic wave generating source.

20. The suction-air system according to claim 19, characterized in that the timing element generates a control signal simultaneously with each control pulse for initiation of an alarm which can be suppressed for the duration of the control pulse.

* * * * *